US006457511B1

(12) United States Patent
Hackman et al.

(10) Patent No.: US 6,457,511 B1
(45) Date of Patent: Oct. 1, 2002

(54) APPARATUS FOR HANDLING FOUNDRY MOLDS

(75) Inventors: Lynn C. Hackman, Helena, AL (US); Larry Wayne Roberts, Bessemer, AL (US)

(73) Assignee: Vulcan Engineering Company, Inc., Helena, AL (US)

( * ) Notice: Subject to any disclaimer, the term of this patent is extended or adjusted under 35 U.S.C. 154(b) by 0 days.

(21) Appl. No.: 09/729,522

(22) Filed: Dec. 4, 2000

(51) Int. Cl.[7] ..... B22D 5/04; B22D 47/00

(52) U.S. Cl. ..... 164/324; 164/330; 164/331; 164/130

(58) Field of Search ..... 164/130, 18, 322, 164/324, 323, 29, 329, 330, 331

(56) References Cited

U.S. PATENT DOCUMENTS 3,627,028 A * 12/1971 Carignan ..... 164/323
3,731,822 A * 5/1973 Friesen et al. ..... 214/1 BC
3,743,004 A * 7/1973 Becke ..... 164/18
3,955,613 A * 5/1976 Lund ..... 164/130
4,422,495 A * 12/1983 Van Nette, III ..... 164/324
4,621,967 A * 11/1986 Masada ..... 414/225
5,927,374 A * 7/1999 Hunter et al. ..... 164/130
6,052,969 A * 4/2000 Hart et al. ..... 53/447
6,126,384 A * 10/2000 Darcy et al. ..... 414/800
6,145,577 A * 11/2000 Hunter et al. ..... 164/323

* cited by examiner

*Primary Examiner*—M. Alexandra Elve
*Assistant Examiner*—Kevin McHenry
(74) *Attorney, Agent, or Firm*—Christopher A. Holland; Robert J. Veal; Burr & Forman LLP

(57) ABSTRACT

An offset conveyor system utilizes a lower conveying section positioned adjacent a pouring station where molten metal is poured into weighted and jacketed sand molds. Molds are transported on carriers along the lower section from a mold loading station to a weight and jacket placement station to the pouring station. After pouring, the carrier with jacketed mold is moved up an incline to an upper conveying section parallel the lower section and may overlap the lower section partially. Molds are transported in an opposite linear direction relative to the lower section to a weight and jacket removal station and to a mold dump station, where the sand mold and casting are removed from the conveyor. The carrier is returned to the lower conveyor section to receive another mold. The weight and jacket removed from the upper section is placed on a mold on the lower section, therefore only a minimum number of weights and jackets are used. The mold carriers may be dimensioned to carry sand molds in side by side relation thus, castings may circulate more than one circuit on the conveyor to permit additional cooling and solidification if necessary or multiple pourings may be accomplished.

25 Claims, 8 Drawing Sheets

APPARATUS FOR HANDLING FOUNDRY MOLDS

FIELD OF THE INVENTION

The present invention relates to the field of foundry operations and more particularly to the field of castings wherein conveyors are utilized to move sand molds to various stations along a casting line. In greater particularity, the present invention relates to a casting line utilizing a weight and jacket about the sand molds and a pouring line as well as a discharge line. In still further particularity, the present invention relates to a conveyor system wherein the pouring line and discharge line are at different elevations and to the mechanism for handling castings and molds on said conveyor.

BACKGROUND OF THE INVENTION

The art of casting metal objects in sand molds is ancient. Numerous advances have been made in the art including the automation of the process and the integration of conveyors into the process. Certain elements of casting are invariable, thus one of the problems is to adapt the environment in which the castings are made to fit the available resources. One increasingly evident factor is cost. As the cost per square foot of building space increases, the casting line becomes more expensive. Likewise, the greater cost of installation yields a reduced likelihood of adoption of a particular line. Numerous patents have addressed the problems associated with the space limitation as well as the time limitation. That is to say, a conveyor has to have sufficient length to allow a molten casting to solidify before the casting can be discharged, thus a continuously operated conveyor has a finite number of incremental movements between the time the casting is poured and the casting is discharged. The cumulative dwell time of a casting on the incremental positions must equal the length of time required before the casting can be discharged. Where space is not a problem, the casting line could be any length needed, however, space is generally a problem.

SUMMARY OF THE INVENTION

It is an object of the present invention to provide an automated casting line having minimal floor space requirements and minimal installation requirements in terms of site preparation.

Another object of the invention is to provide a system, which permits ready access to the various stations for maintenance and repair.

These and other objects of the invention are provided by an offset conveyor system wherein a lower section of the conveyor is positioned adjacent a pouring station where molten metal is poured into weighted and jacketed sand molds. Molds are transported on carriers along the lower section from a mold loading station to a weight and jacket placement station to the pouring station. After pouring, the carrier with jacketed mold is moved upwardly to an offset upper conveyor section that is parallel the lower section and may overlap the lower section partially. Molds are transported in an opposite linear direction relative to the lower section, to a weight and jacket removal station and to a mold dump station, where the sand mold and casting are removed from the conveyor. The carrier is returned to the lower conveyor section to receive another mold. The weight and jacket removed from the upper section is placed on a mold on the lower section, therefore only a minimum number of weights and jackets are used. The mold carriers may be dimensioned to carry sand molds in side by side relation, thus castings may circulate more than one circuit on the conveyor to permit additional cooling and solidification if necessary.

BRIEF DESCRIPTION OF THE DRAWINGS

Apparatus embodying the features of my invention are depicted in the accompanying drawings which form a portion of this disclosure and wherein.

DESCRIPTION OF THE PREFERRED EMBODIMENT

Figure 1:
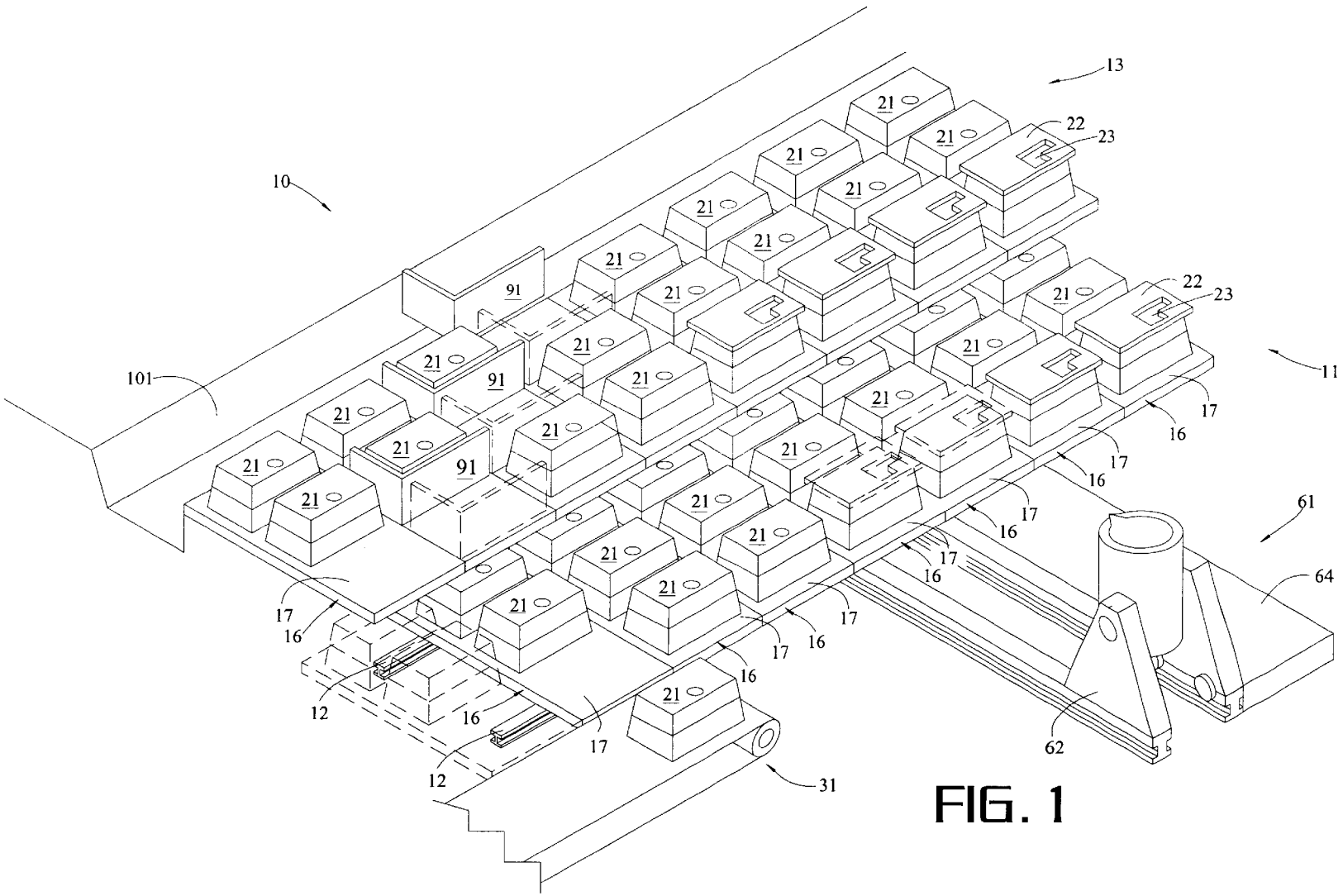
FIG. 1 is a perspective view of the system.
Figure 2:
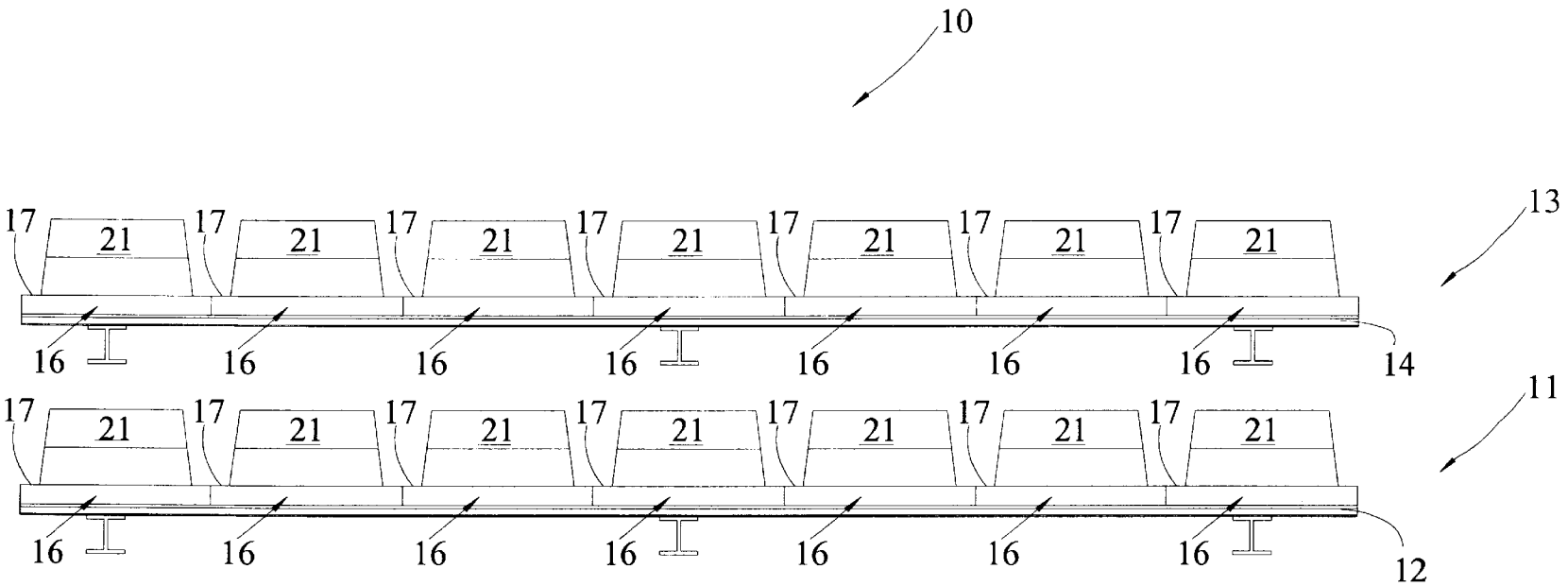
FIG. 2 is a side elevation of the system.

Referring to the drawings for a clearer understanding of the invention it will be seen in FIG. 1, that the present invention is a conveyor system on which molds are transported, filled with molten metal and discharged after the molten metal has sufficiently cooled to permit removal of the mold and subsequent handling. The present invention permits pouring of the molten metal at a lower location and discharging the metal at an upper location, hence eliminating the need for an excavated pit at the discharge location. Accordingly, the conveyor 10 includes a lower conveyor section 11 defined by a set of parallel linear tracks 12 of a selected length and an upper conveyor section 13 defined by a set of parallel linear tracks 14 of an equivalent length. As will be understood, the cooling of metal poured into a mold requires a certain passage of time, thus tracks 12 and 14 must be long enough to permit cooling. Supported on the tracks are a plurality of mold carriers 16, each defined by an upper platform 17 supported on a plurality of wheels 18 which are positioned to ride along tracks 12 and 14. The wheels may be flanged or may be caster wheels with rail guides as are known in the art. It is possible that the tracks could be replaced with roller conveyors with appropriate flat-bottomed carriers. Such a system would require appropriate side guides and stops in the various stations. The upper surface of the platforms is substantially flat to receive formed sand molds 21 thereon at a loading station 31. As will be understood, the sand molds 21 are formed with any suitable mold making machinery and are slid onto platform 17 in position on the carrier to subsequently be filled with molten metal. The carriers 16 are not interconnected but rather abut at their forward and trailing ends. Platform 17 may be dimensioned to receive a single sand mold, however, it is often desirable to retain more than one mold on the carrier to enable a longer cooling time for the molten metal. Therefore the platform dimension is preferentially sufficient to accommodate three molds thereon without interference between the molds.

Figure 3:
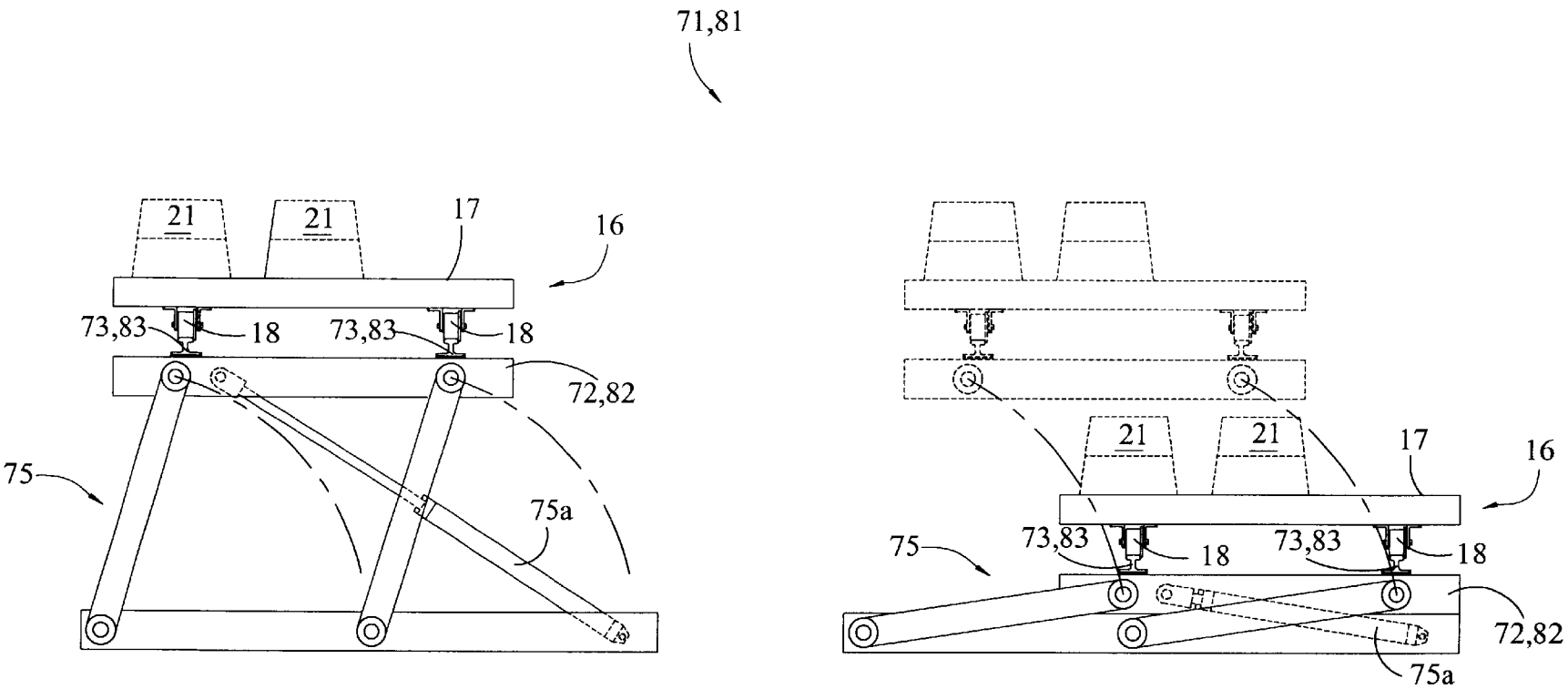
FIG. 3 is a detailed view of the elevator system.
Figure 6:
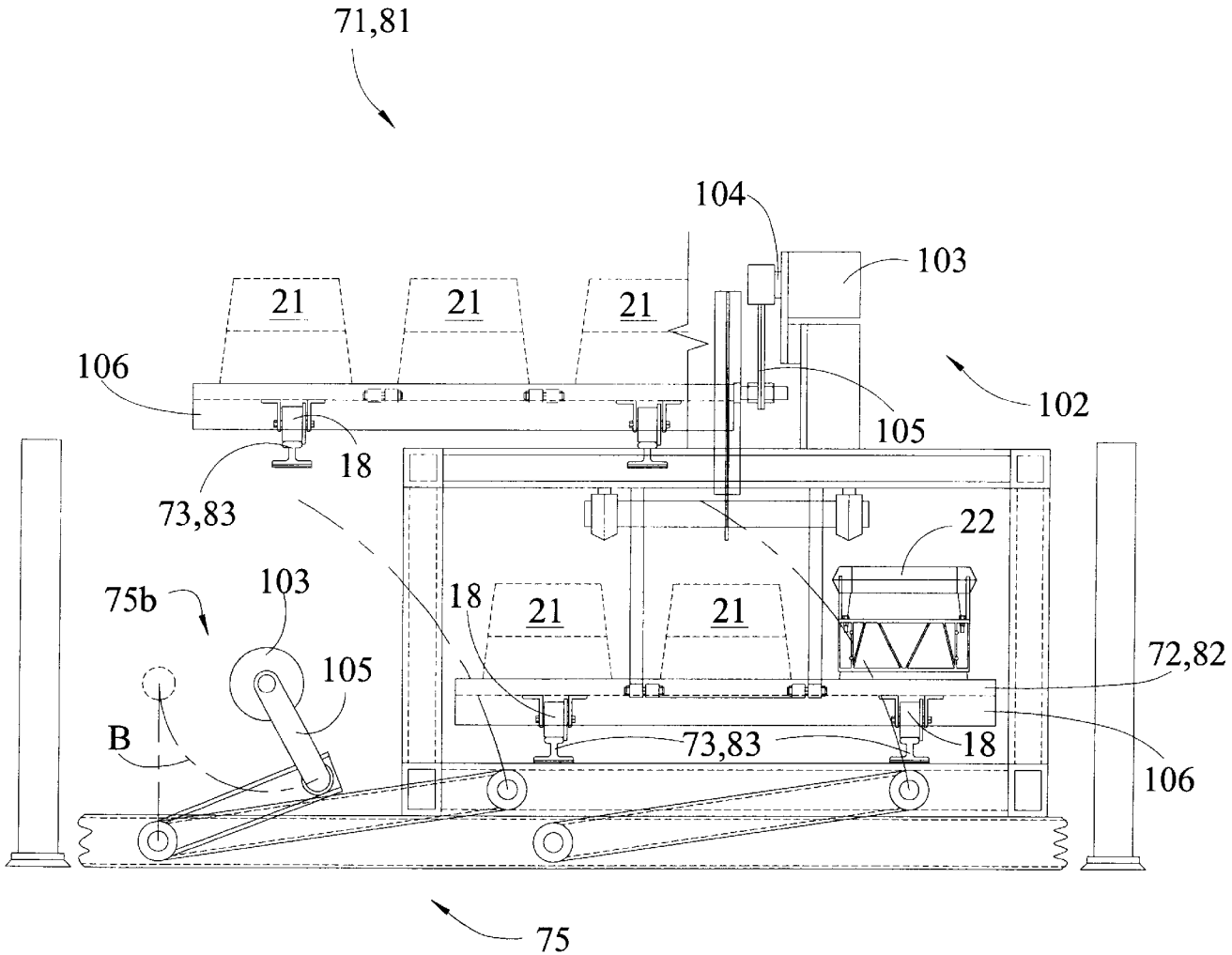
FIG. 6 is a detailed view of a fourth embodiment of the elevator system.
Figure 7:
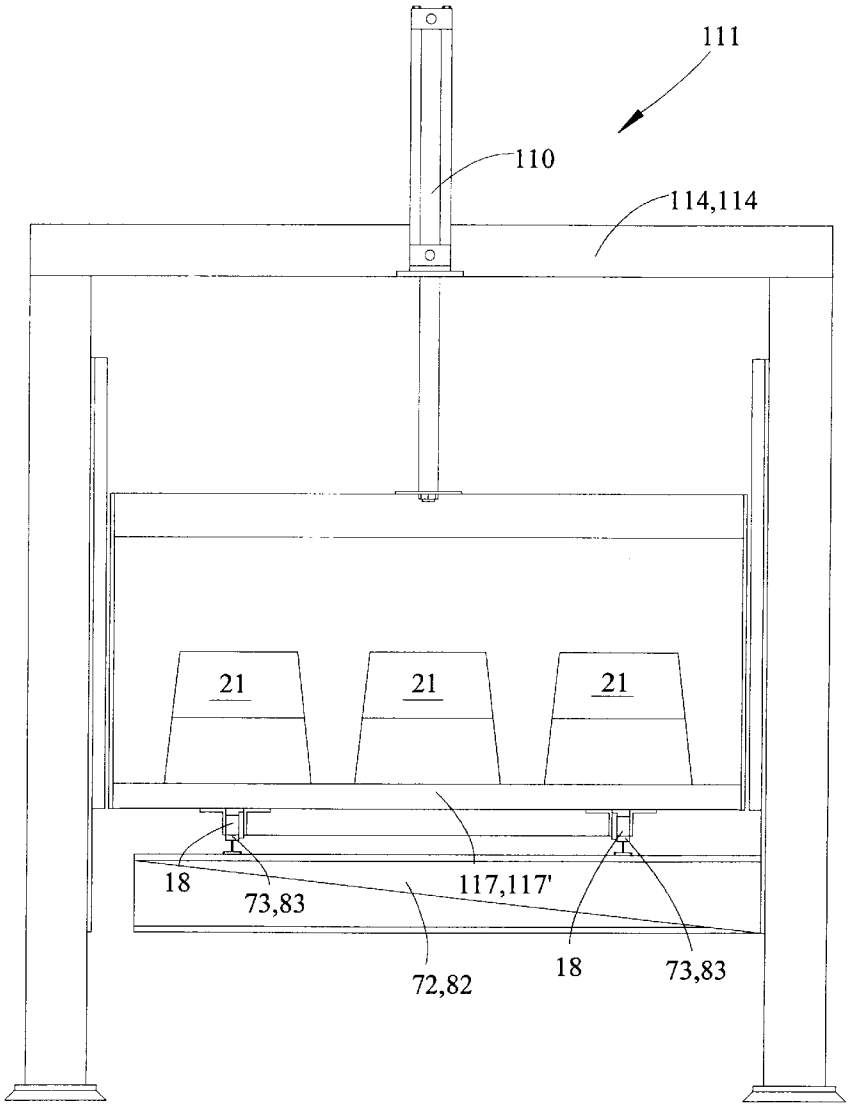
FIG. 7 is a view of the drive system.
Figure 7:
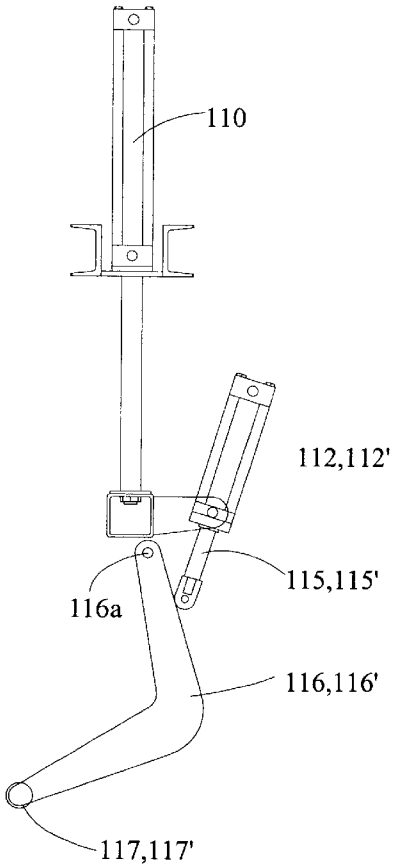
Figure 8:
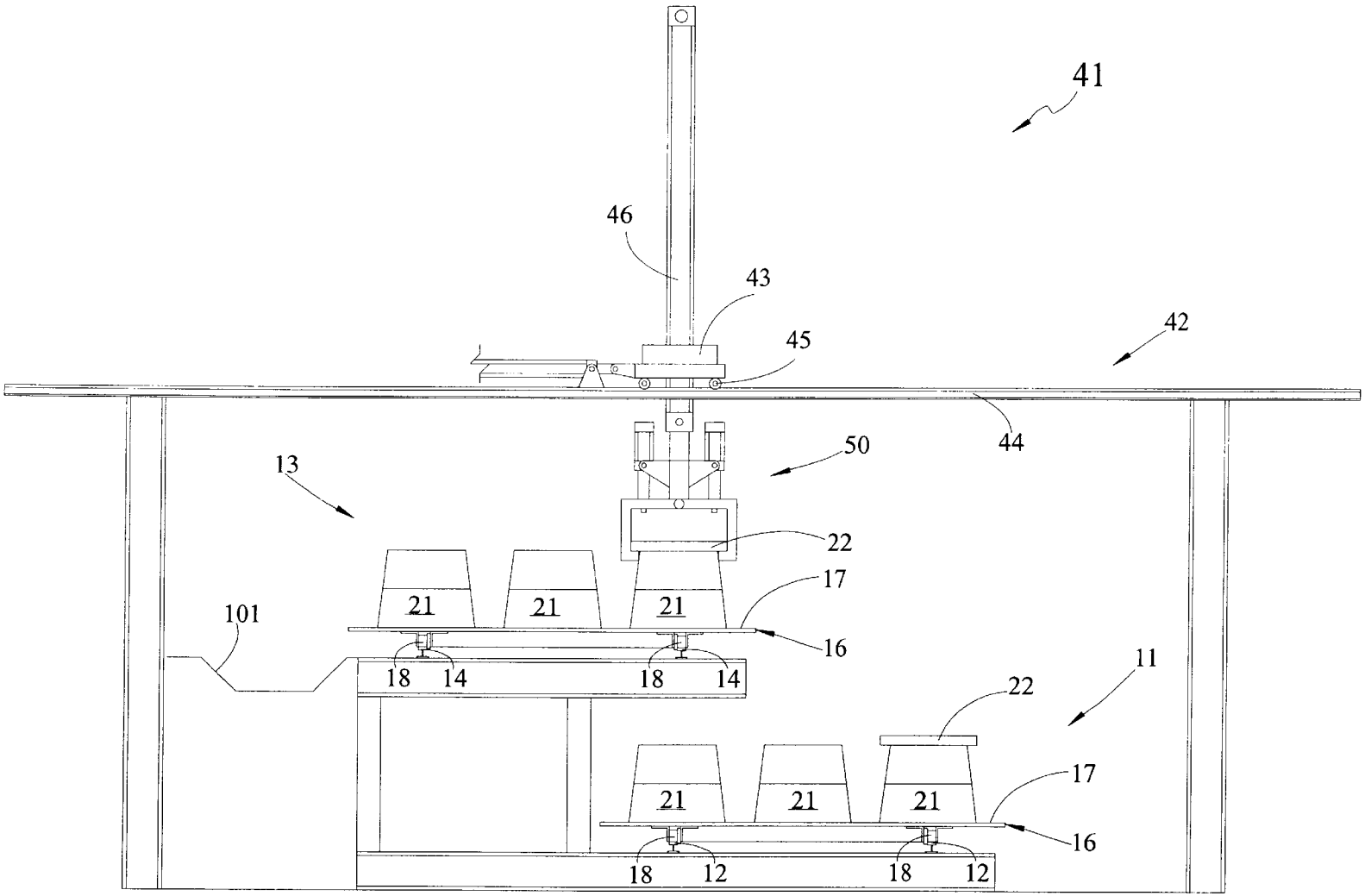
FIG. 8 is a view of the jacket shift and frame.

The carriers 16 on lower section 11 are all moved concomitantly by a linear actuator 75*a* or rotary actuator 75*b*, as shown in FIGS. 3 and 6, which will be described hereinafter, such that each carrier 16 may be brought into alignment with loading station 31 to receive a fresh sand mold 21. Thus, either actuator 75*a* or 75*b* may be used to move the carriers one carrier length at a time. Prior to pouring molten metal into the sand molds 21, the molds must be encased within a weight and jacket assembly 22 as is well known in the art. In the preferred embodiment, the weight and jacket assembly 22 is removed from a sand mold 21 on upper conveyor 13 and placed on a waiting mold 21 on lower conveyor 11. Thus, a weight and jacket shifter 41 is provided including a frame 42 extending transverse to conveyor 11 and 13 at a height sufficient to allow a weight and jacket 22 to be lifted off a sand mold 21 on conveyor 13 and moved laterally. Frame 42 extends over conveyor 11 sufficiently to. allow the weight and jacket removed from conveyor 13 to be lowered to encase a sand mold 21 supported on conveyor 11. As is understood, weight and jacket 22 have a formed aperture 23 therein to permit pouring of molten metal into mold 21. To accomplish the movement of the weight and jacket assembly, a cross shuttle 43 is mounted to frame 42 and moves linearly on a set of rails or guides 44 engaged by either shuttle wheels 45 or a slide. The shuttle may be conventionally driven in any suitable manner, such as by a controllable linear actuator that provides accurate positioning, by a worm gear or by a stepper motor mounted to shuttle 43. Since the drive mechanisms are all well known, the drive is shown generically in FIG. 1. Mounted to shuttle 43 is a gripping assembly or magnetic engagement assembly 50 which is movable vertically under the control of a hydraulic cylinder 46 to engage, lift, lower, set, and release the weight and jacket 22. Such assemblies 50 are well known in the art and may be of any commercially acceptable configuration, which can engage and support the weight and jacket assembly.

After the weight and jacket 22 are placed on the mold 21, the line of carriers 16 is advanced to bring the next empty mold to the pouring station 61. At this station a manual or automated pouring process introduces molten metal through the formed aperture into the empty sand mold. Commercially available robotic ladle handling units 62 can be used to repetitively pour molten metal obtained from a furnace, shown schematically for illustrative purposes only. If manual pouring is desired, an appropriate platform 64 and ladle track may be constructed adjacent lower conveyor section 11 at the pouring station 61. Once the metal has been poured into the mold, the conveyor is indexed, bringing a fresh mold to the pouring station and moving cooling molds away from the pouring station. At the end of conveyor 11 is an elevator 71 which receives a mold carrier 16, mold 21, and weight and jacket 22 on an elevator platform 72 on which a cooperative track 73 is supported. A set of stops 74 secures the mold carrier against inadvertent movement while on the elevator. The elevators, preferably, take the form of a parallelogram linkage 75, as shown in FIGS. 3 and 6, having a horizontally disposed platform 72 movable selectively between positions adjacent the conveyors 11 and 13 for receiving and discharging mold carriers therefrom. Parallelogram linkage 75 is selectively movable between the conveyors by a linear actuator 75*a* as shown in FIG. 3 or by a rotary actuator 75*b*, partially shown in FIG. 6. Rotary actuator 75*b* includes a reversible motor 103 of any suitable type, which has an output shaft 104 which rotates through an arc B and concomitantly moves an attached arm 105 through the same arc. Arm 105 is attached to linkage 75 to selectively move the linkage between upper and lower conveyors.

Figure 4:
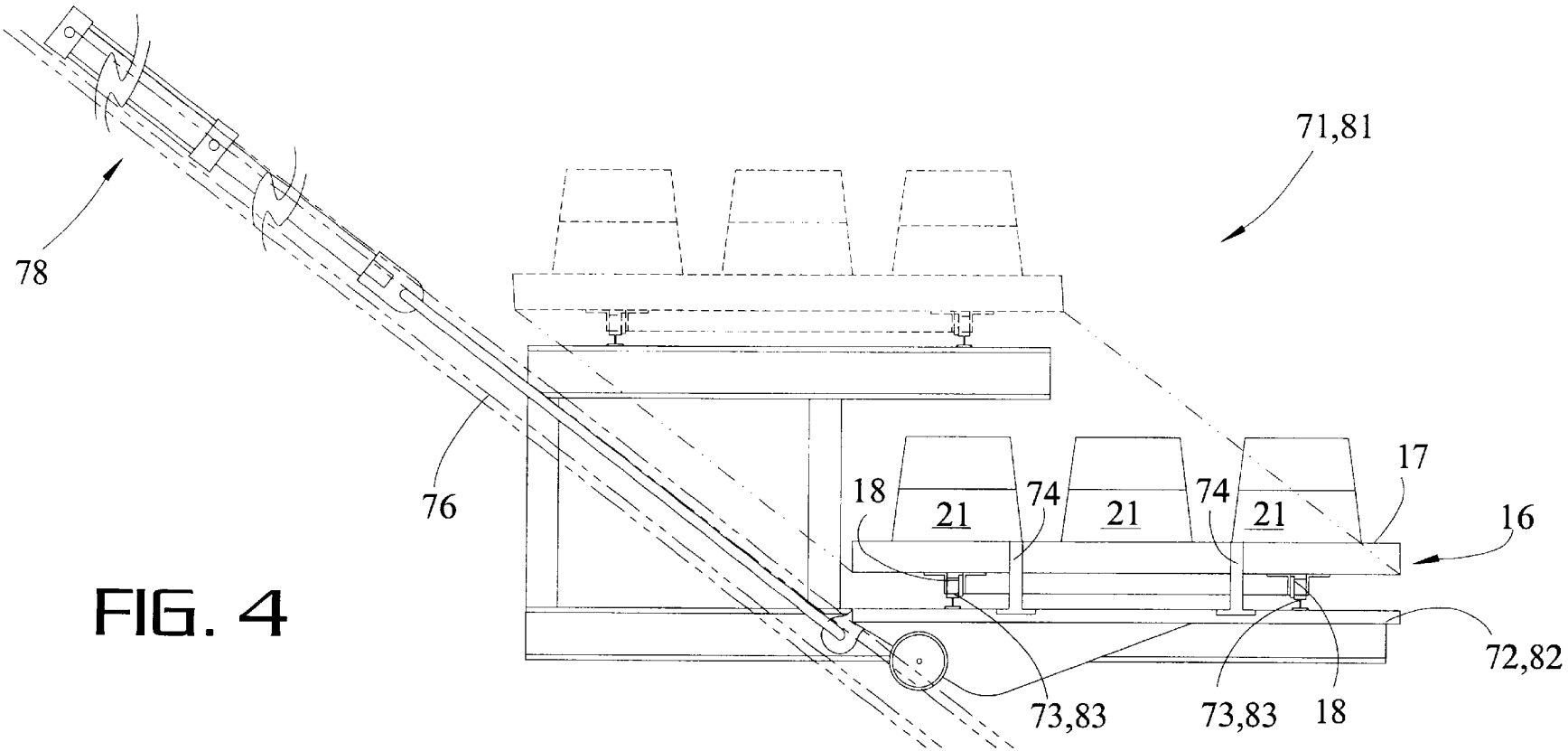
FIG. 4 is a detailed view of a second embodiment of the elevator system.
Figure 5:
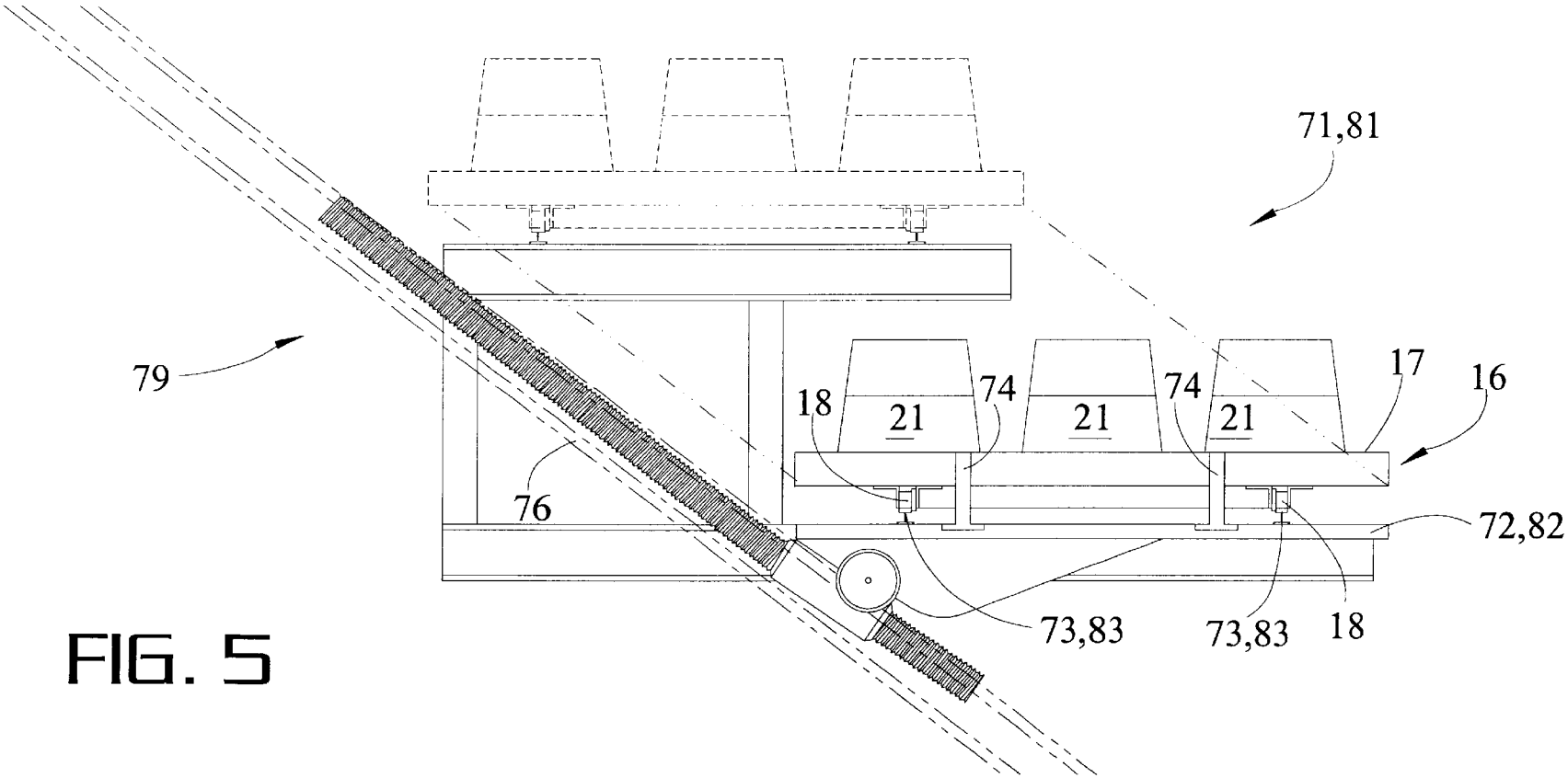
FIG. 5 is a detailed view of a third embodiment of the elevator system.

Alternatively, the elevator platform 72 may move on an inclined guide track 76 between a lower position aligned with conveyor 11 and an upper position aligned with conveyor 13. As seen in FIGS. 4 and 5, a linear actuator 78, or a worm gear 79, or any suitable source of motive power which can supply a smooth and repeatable movement between the upper and lower positions. It will be appreciated that platform 72 and track 73 must accommodate the carriers on conveyors 11 and 13, thus the elevator may need to transport three castings at once on a mold carrier.

Once a carrier 16 is elevated to conveyor 13, the driver mechanism urges the carrier from the elevator platform onto track 14, thereby indexing the carriers on the track. It will be appreciated that a lowering elevator 81 at the opposite end of conveyor 14, having the same features as elevator 71, must be in position to receive a carrier 16 on a set of rails 83 supported on a platform 82 when the carriers are indexed along conveyor 14. Elevators 71 and 81 must therefore move concomitantly between upper and lower positions to ensure that the mold carriers are properly indexed to and from the conveyors.

When a mold carrier 16 bearing a weighted and jacketed mold and casting on conveyor 13 reaches a position parallel the weight and jacket station 41 of conveyor 11, it will be in position beneath the upper reach of station 41 such that the engagement assembly 50 can engage and lift the weight and jacket from the mold for placement on a fresh mold on lower conveyor 11. After the carrier is indexed beyond this station, a mold shifter 91 is employed to move the mold and internal casting laterally. If the carrier 16 is dimensioned to support only one mold, then the lateral movement urges the sand mold and metal casting off the conveyor onto a shake out conveyor 101 wherein the sand and casting are separated with the sand sent to a reclaim process and the casting conveyed for further processing such as deburring and spur removal. If the carrier 16 is wide enough to accommodate more than one mold 21, then the lateral movement moves one mold off the conveyor 13 onto shakeout conveyor 101 and moves the remaining mold and casting laterally sufficiently to accommodate a new mold when the carrier is returned to the mold loading station. Accordingly, the mold shifter 91 is designed to accommodate the width of the carrier, however, shifter 91 will be essentially a movable panel (not illustrated) urged across the top of the carrier by a cylinder (not illustrated) such that substantially all of the sand is moved by a lateral force applied to the mold. It will be appreciated that the same type mold shifter will be used to load sand molds and that such mold shifters are of conventional design.

The indexing of the carriers 16 on conveyors 11 and 13 is accomplished using a pusher type hydraulic cylinder assembly 111 or a rotary actuator 102. In FIG. 6 it may be seen that rotary actuator 102 is similar to actuator 75*b* and comprises a motor 103 which may be hydraulic or electrical. Motor 103 is reversible and controllable. Motor 103 has an output shaft 104, which rotates through an arc A and concomitantly moves an attached arm 105 through the same arc. Arm 105 carries a cross bar 106 which abuts carrier 16. Arc A is intended to move cross bar 105 and carrier 16 one carrier length, thereby moving the entire sequence of carriers on the conveyor one carrier length. It will be appreciated that an actuator 102 is associated with each conveyor 11 and 13. In another embodiment, -a cylinder 110 is mounted vertically adjacent elevator platform 72 to move assembly 111 concomitantly with and adjacent elevator platform 82. In fact the cylinders may be mounted on a frame 114, 114'. Each assembly has a cylinder 112, 112' and rod 115, 115' that engages a pivotally mounted substantially dogleg frame 116, 116'. The frame 116, 116' is supported at an upper end 116*a* for rotation about a horizontal axis, with the lower end affixed to a horizontally disposed pusher bar 117, 117'. Bar 117 engages a carrier 16 on lowering elevator platform 72 to urge carrier 16 and each adjacent carrier on conveyor 11 horizontally responsive to downward movement of rod 115. Concomitantly, rod 117' moves horizontally responsive to the upward movement of piston rod 115'. The rods 117, 117' may thus stabilize the line of carriers and assist in positioning the carriers in the various stations. Likewise, when elevator 72 has conveyed a carrier 16 to upper conveyor 13, rod 117' engages the carrier 16 and urges the carrier and adjacent carriers horizontally along conveyor 13 responsive to downward movement of rod 113, 113'. Alternative triangular frame 116 and cylinder 110 may be supported on platform 72, 82.

It will be appreciated that the mold carriers are circulated from the lower carrier to the upper carrier and back again, and those sand molds initially enter the circulating carrier loop on the lower carrier. If each carrier had more than one mold thereon, then a mold with a cooling casting therein moves on conveyor 11 from the pouring station to elevator 72 to conveyor 13 to mold shift station 91 at which point the mold is moved laterally, then to lowering elevator 82 to carrier 11, to elevator 72, to conveyor 13 to the shift station, whereupon the mold and casting are discharged to shakeout conveyor 101. If more than two molds are supported on each carrier then each mold may be carried through another cycle for extended cooling. In the multimold per mold carrier arrangement, the inboard mold on the mold carrier could be partially or completely subjacent the inboard mold carrier of the upper conveyor, thus affording a savings of installation space.

In yet another embodiment, each carrier supports two sand molds in side by side relation. The molds are loaded at the mold loading station in tandem. The pouring station utilizes two pouring robots, such that both molds are filled with molten metal. If necessary the inboard mold may be filled first and the outboard mold filled second or the inboard and outboard molds on adjacent carriers may be filled. When the carriers are moved to the upper conveyor the outboard mold (inboard on lower conveyor) is off loaded first onto the shakeout conveyor. Since the upper and lower conveyors are offset, the pouring station and weight and jacket station can operate without interference from the upper conveyor. For castings that are amenable to shakeout after one pass on the conveyor, the dual filling capability effectively doubles the capacity of the system with minimal increase in space and equipment. Further, the height of the upper conveyor can be such that no excavation is needed to install the shakeout conveyor. Use of the articulated drivers likewise reduces the space required to install the system. Accordingly, a much smaller footprint and much less costly installation is possible with the present invention.

While the apparatus has been disclosed in various forms, these are intended as illustrations rather than limitations, and the intended scope of the invention is set forth in the claims.

What I claim is:

1. Apparatus for casting items in sand molds comprising a conveyor having an upper conveyor section at a first elevation, including a plurality of mold carrier positions sequentially arranged; a lower conveyor section at a second elevation, including a plurality of mold carrier positions sequentially arranged, said lower conveyor section adjacent said upper conveyor section and offset laterally from said upper section;

a plurality of mold carriers positioned on said upper conveyor section and said lower conveyor section for iterative sequential motion to each of said mold carrier positions on said upper conveyor section and said lower conveyor section, each mold carrier adapted for supporting and transporting at least one sand mold;

a lift elevator positioned intermediate said upper conveyor section and said lower conveyor section for transferring individual mold carriers from said lower conveyor section to said upper conveyor section;

a lowering elevator positioned intermediate said upper conveyor section and said lower conveyor section for transferring said individual mold carriers from said upper conveyor section to said lower conveyor section;

a mold transfer station for placing sand molds on said mold carriers at a first location on said lower conveyor section;

a weight and jacket transfer station for placing a weight and jacket about a sand mold at a second location on said lower conveyor section and for removing a weight. and jacket from a sand mold from a first location on said upper conveyor section;

a pouring station proximate said lower conveyor section for pouring molten metal into said sand molds on said lower conveyor section to form a casting; and, a casting removal station intermediate said first location on said upper conveyor section and said lowering elevator at which said sand molds and said casting are concomitantly removed from said mold carriers.

2. Apparatus as defined in claim 1 wherein said mold conveyor is a track and wherein said upper conveyor section and said lower conveyor section are parallel.

3. Apparatus as defined in claim 2 wherein said wherein said upper conveyor section and said lower conveyor section are linear.

4. Apparatus as defined in claim 2 or 3 wherein said wherein said upper conveyor section and said lower conveyor section are of equal length.

5. Apparatus as defined in claim 1 further comprising an actuator for concomitantly moving all mold carriers from one mold carrier position to an adjacent mold carrier position on the same section.

6. Apparatus as defined in claim 5 further comprising a frame for supporting said actuator adjacent one end of a conveyor section proximal an elevator delivering said mold carrier to said section; a bell crank operably connected to said actuator for selective movement about a bell crank axis perpendicular to said section, said bell crank positioned to engage a proximal mold carrier and concomitantly selectively urge said mold carrier and each mold carrier adjacent thereto along said section.

7. Apparatus as defined in claim 1 wherein said elevators comprise a horizontally disposed platform adapted for selective alignment with said first and second conveyor sections, said platform mounted on and movable by a parallelogram linkage between said upper conveyor section and said lower conveyor section.

8. Apparatus as defined in claim 1 wherein said elevators comprise an inclined track proximal the ends of said upper conveyor section and said lower conveyor section, a horizontally disposed platform supported on said inclined track for movement between positions adjacent the ends of said conveyor sections having a section of track mounted thereon and adapted for selective alignment with a track defining said lower conveyor section and a track defining said upper conveyor section.

9. Apparatus as defined in claim 8 further comprising a linear actuator attached to said horizontally disposed platform for selectively urging said platform along said inclined track between said conveyor sections.

10. Apparatus as defined in claim 8 further comprising a drive screw and head affixed to said horizontally disposed platform for selectively urging said platform along said inclined track.

11. Apparatus as defined in claim 1 wherein said weight and jacket transfer station comprises a transfer shuttle extending transversely of said upper conveyor section and said lower conveyor section, a vertically movable gripper mounted to said transfer shuttle and selectively extendable to selectively engage and lift a weight and jacket assembly relative to one of said conveyor sections and lower and release said jacket assembly relative to another one of said conveyor sections.

12. Apparatus as defined in claim 1 wherein said mold carriers are dimensioned to support a plurality of molds in side by side relation.

13. Apparatus for producing castings, wherein said castings are formed by pouring molten metal from a pouring station into molds produced by a sand mold forming machine, comprising in combination:

a. a lower substantially linear conveyor mounted at a first elevation to receive sand molds formed by a sand mold forming apparatus and transport said sand molds to a pouring station for pouring of molten metal thereinto;

b. an upper substantially linear conveyor parallel to said first conveyor and supported at a second elevation, c. a first elevator mounted at a first end of said upper conveyor and said lower conveyor to receive molds containing metal from said lower conveyor and lift said molds to said upper conveyor;

d. a second elevator mounted at a second end of said upper conveyor and said lower conveyor and connecting said conveyors;

e. a mold removal station positioned adjacent said upper conveyor and adapted for removal of said mold and metal casting from said upper conveyor, wherein said upper conveyor is offset laterally from said lower conveyor for the molten metal to be poured into molds on said lower conveyor.

14. The apparatus as defined in claim 13 further comprising a plurality of mold carriers positioned on said upper conveyor and said lower conveyor for iterative sequential motion to each of a number of discrete mold carrier positions on said upper conveyor and said lower conveyor, each mold carrier adapted for supporting and transporting at least one sand mold.

15. The apparatus as defined in claim 14 further comprising a weight and jacket transfer station for placing a weight and jacket about a sand mold at a location on said lower conveyor and for removing a weight and jacket from a sand mold from a first location on said upper conveyor.

16. The apparatus as defined in claim 15 wherein said upper conveyor and said lower conveyor are offset sufficiently to permit said weight and jacket transfer station to place said weight and jacket about said sand mold on said lower conveyor by vertical movement of the weight and jacket.

17. Apparatus as defined in claim 15 wherein said weight and jacket transfer station comprises a transfer shuttle extending transversely of said upper conveyor and said lower conveyor, a vertically movable gripper mounted to said transfer shuttle and selectively extendable to selectively engage and lift a weight and jacket assembly relative to said upper conveyor and lower and release said jacket assembly relative to said lower conveyor.

18. The apparatus as defined in claim 14 wherein each of said mold carriers are sequentially transported by said first and second elevators between said upper conveyor section and said lower conveyor.

19. Apparatus as defined in claim 13 further comprising an actuator for concomitantly moving all mold carriers from one mold carrier position to an adjacent mold carrier position on the same conveyor.

20. Apparatus as defined in claim 19 further comprising a frame for supporting said linear actuator adjacent one end of a section proximal an elevator delivering said mold carrier to said section; a bell crank operably connected to said linear actuator for selective movement about a bell crank axis perpendicular to said section, said bell crank positioned to engage a proximal mold carrier and concomitantly, selectively urge said mold carrier and each mold carrier adjacent thereto along said section.

21. Apparatus as defined in claim 13 wherein said elevators comprise an inclined track proximal the ends of said conveyors, a horizontally disposed platform supported on said inclined track for movement between positions adjacent the ends of said conveyors having a section of track mounted thereon and adapted for selective alignment with a track defining said lower conveyor and a track defining said upper conveyor.

22. Apparatus as defined in claim 21 further comprising a linear actuator attached to said horizontally disposed platform for selectively urging said platform along said inclined track between said conveyor sections.

23. Apparatus as defined in claim 21 further comprising a drive screw and head affixed to said horizontally disposed platform for selectively urging said platform along said inclined track.

24. Apparatus as defined in claim 14 wherein said mold carriers are dimensioned to support a plurality of molds in side by side relation.

25. Apparatus as defined in claim 13 wherein said elevators each comprise a parallelogram linkage having a horizontally aligned platform movable between positions adjacent said upper conveyor and said lower conveyor.

* * * * *